US007823403B2

(12) United States Patent
Sapir

(10) Patent No.: US 7,823,403 B2
(45) Date of Patent: Nov. 2, 2010

(54) MEMS COOLING DEVICE

(76) Inventor: Itzhak Sapir, 27 Foxhill, Irvine, CA (US) 92604

( * ) Notice: Subject to any disclaimer, the term of this patent is extended or adjusted under 35 U.S.C. 154(b) by 582 days.

(21) Appl. No.: 11/511,117

(22) Filed: Aug. 26, 2006

(65) Prior Publication Data

US 2007/0048154 A1 Mar. 1, 2007

Related U.S. Application Data

(60) Provisional application No. 60/711,376, filed on Aug. 26, 2005.

(51) Int. Cl.
*F25D 23/12* (2006.01)
*H05K 7/20* (2006.01)

(52) U.S. Cl. ..... 62/259.2; 62/185; 62/201; 361/699; 165/80.4; 165/120

(58) Field of Classification Search ..... 62/185, 62/201, 259.2, 102; 165/80.4, 120; 361/699; 417/413.1, 417, 550, 552, 555.1
See application file for complete search history.

(56) References Cited

U.S. PATENT DOCUMENTS

| | | | | |
|---|---|---|---|---|
| 3,573,514 | A | 4/1971 | Race | |
| 4,487,340 | A | 12/1984 | Shaffer | |
| 5,362,213 | A * | 11/1994 | Komatsu et al. | 417/418 |
| 5,901,037 | A * | 5/1999 | Hamilton et al. | 165/80.4 |
| 5,955,668 | A | 9/1999 | Hsu | |
| 6,089,089 | A | 7/2000 | Hsu | |
| 6,487,864 | B1 * | 12/2002 | Platt et al. | 62/3.2 |
| 6,578,420 | B1 | 6/2003 | Hsu | |
| 6,598,409 | B2 * | 7/2003 | Shyy et al. | 62/115 |
| 6,715,352 | B2 | 4/2004 | Tracy | |
| 6,892,802 | B2 | 5/2005 | Kelly et al. | |
| 7,084,004 | B2 | 8/2006 | Vaiyapuri et al. | |
| 2004/0042937 | A1 * | 3/2004 | Bentsen et al. | 422/129 |
| 2005/0144968 | A1 * | 7/2005 | Shakespeare | 62/259.2 |
| 2006/0245933 | A1 * | 11/2006 | Balch et al. | 417/182 |

OTHER PUBLICATIONS

Crystal Structures of Electrospun PVDF Membranes and its Separator Application for Rechargeable Lithium Metal Cells by Kun Gao et al. from Materials Science and Engineering B 131 (2006) pp. 100-105.*

Harris, Chad, et al., Fabrication, Modeling, and Testing of Micro-Cross-Flow Heat Exchangers, Journal of Microelectromechanical Systems, vol. 11, No. 6, Dec. 2002, USA.

International Search Report for PCT/US2006/039915 mailed Sep. 14, 2007.

* cited by examiner

*Primary Examiner*—Frantz F. Jules
*Assistant Examiner*—Daniel C Comings

(57) ABSTRACT

A preferred embodiment of the MEMS cooling device of the invention comprises one or more MEMS micro-channel volumes in communication with one or more MEMS micro-pump assemblies wherein each micro-pump assembly comprises a flexure valve, such as a leaf valve and means to drive a coolant through the channel volumes such as an electrostatic interleaved comb drive structure. A preferred embodiment comprises an inlet micro-pump assembly and an outlet micro-pump assembly but the device may also be fabricated with a single pump mechanism per channel volume.

33 Claims, 5 Drawing Sheets

MEMS COOLING DEVICE

CROSS REFERENCE TO RELATED APPLICATIONS

This application claims priority to Provisional Patent Application Ser. No. 60/711,376, entitled "MEMS Cooling Device", filed Aug. 26, 2005, which application is fully incorporated herein by reference.

STATEMENT REGARDING FEDERALLY SPONSORED RESEARCH AND DEVELOPMENT

Not applicable.

BACKGROUND OF THE INVENTION

1. Field of the Invention

The invention relates generally to micro-electro-mechanical systems devices or MEMS devices. More particularly, the invention relates to a micro-electrical mechanical coolant pump and cooling assembly for the removal and transfer of heat generated by one or more integrated circuit chips (ICs) to an external heat exchanger.

2. Description of the Related Art

Microelectronic integrated circuit chips, or ICs, require improved cooling methods for heat removal. Prior art methods of IC cooling use a pressurized fluid, or coolant, flowing across or adjacent the surface of an IC. Heat generated by the operation of the IC is absorbed and transferred to the coolant. The heated coolant is then circulated to an external heat exchanger in another part of the system where the heat is removed before it is circulated back to the IC(s) in a manner similar to that of an internal combustion engine radiator assembly.

Very small cooling system feature size can be achieved using MEMS technology to fabricate pump assemblies for use in IC cooling or for insertion into three-dimensional micro-electronic modules such as those disclosed in U.S. Pat. No. 6,967,411 to Eide, U.S. Pat. No. 6,806,559 to Gann, et al., U.S. Pat. No. 6,784,547 to Pepe, et al., U.S. Pat. No. 6,734,370 to Yamaguchi, et al., U.S. Pat. No. 6,706,971 to Albert, et al., U.S. Pat. No. 6,117,704 to Yamaguchi, et al., U.S. Pat. No. 6,072,234 to Camien, et al., U.S. Pat. No. 5,953,588, to Camien, et al., U.S. Pat. No. 4,953,533 to Go, U.S. Pat. No. 5,104,820 to Go, and U.S. Pat. No. 5,688,721 to Johnson, all assigned to common assignee, Irvine Sensors Corp. and each of which is incorporated fully herein by reference.

Established MEMS fabrication processes can create high aspect ratio features, (i.e., vertical sidewalls, valve members, flexures, drive mechanisms or micro-channels) with dimensions of a few microns. MEMS fabrication and feature size attributes provide the ability to create a MEMS micro-pump that can circulate a coolant through a system in a very small volume for IC heat transfer to an external heat exchanger.

The use of MEMS-fabricated micro-channels for heat absorption and removal from microelectronic devices is thermally efficient due to the large surface area available for heat exchange. However, the high flow resistance introduced by a very small flow cross-section (e.g., 10 microns or less) of a micro-channel structure presents a problem for practical pumping devices. Where an external central coolant pump (i.e., separate from the IC to be cooled) is required for the circulation of a coolant through several IC components, there is a relatively high fluid pressure necessary to maintain such coolant flow. This, in turn, requires the cooling system be capable of withstanding high pump pressure at the risk of coolant line breakage and leakages. Further, the pumping pressure requirement changes with a change in the number of cooled components, making the control of coolant flow and temperature control more difficult.

This problem can be solved if a pump is provided that is small enough to allow its positioning in very close proximity to every channel in a micro-channel MEMS structure. By having the pump assembly proximal the micro-channels, only the micro-channel(s) are required to withstand the pumping pressure while the coolant pressure in the rest of the cooling system is maintained at relatively low pressure levels. Because the remaining elements of the cooling system are not required to withstand high continuous pressure levels, their reliability and manufacturability are improved.

What is needed is a micro-pump structure for the cooling of one or more ICs that possesses the above desirable attributes and overcomes the aforementioned problems.

BRIEF SUMMARY OF THE INVENTION

A preferred embodiment of the MEMS cooling device of the invention comprises one or more MEMS micro-channel volumes in communication with one or more MEMS micro-pump assemblies wherein each micro-pump assembly comprises a flexure valve, such as a leaf valve, and means to drive a coolant through the micro-channel volumes such as an electrostatic interleaved comb drive structure. A preferred embodiment comprises an inlet micro-pump assembly and an outlet micro-pump assembly but the device may also be fabricated with a single pump mechanism per channel volume.

DETAILED DESCRIPTION OF THE INVENTION

Figure 1:
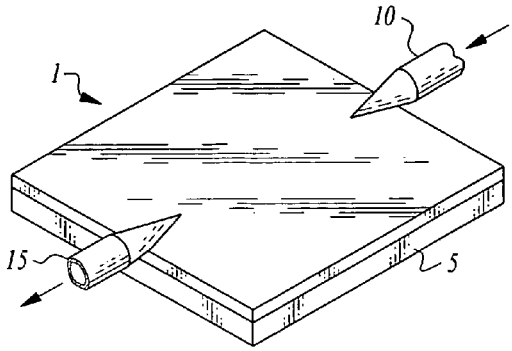
FIG. 1 shows the sealed MEMS cooling device of the invention bonded to an integrated circuit chip.

Turning now to the figures wherein like numerals designate like elements among the several views, FIG. 1 shows the MEMS cooling device 1 of the invention bonded to an integrated circuit die 5 by use of eutectic bonding or a suitable adhesive.

Inlet conduit 10 and outlet conduit 15 are in fluid communication with the interior of MEMS cooling device 1 for the circulating of a coolant fluid into and out of MEMS cooling device 1 to an external heat exchanger apparatus (not shown). FIG. 1 reflects a MEMS device that has been sealed with a top seal or "lid" structure to define one or more interior channel volumes, one or more MEMS micro-pump assemblies comprising one or more valve elements as is more fully discussed below.

In a preferred method of fabricating the preferred embodiments of the invention, established MEMS processes are used to define interior elements of the device, such as, by way of example and not by limitation, silicon-on-insulator (SOI), bulk silicon or polysilicon foundry processes used with, for example, a dry reactive ion etching (DRIE) process, wet etch or low power plasma in an $SF_6$ compound gas, as appropriate, capable of defining very small, high aspect ratio apertures, well-defined vertical sidewalls and high tolerance, three-dimensional structures in a silicon substrate.

Subsequent to the MEMS fabrication of the interior elements of the device, a lid structure, preferably fabricated from the same material as the interior elements for an improved coefficient of thermal expansion (CTE) match, is bonded to the top perimeter portion of the interior element assembly, using, for instance eutectic bonding, an adhesive or other suitable means.

Figure 2:
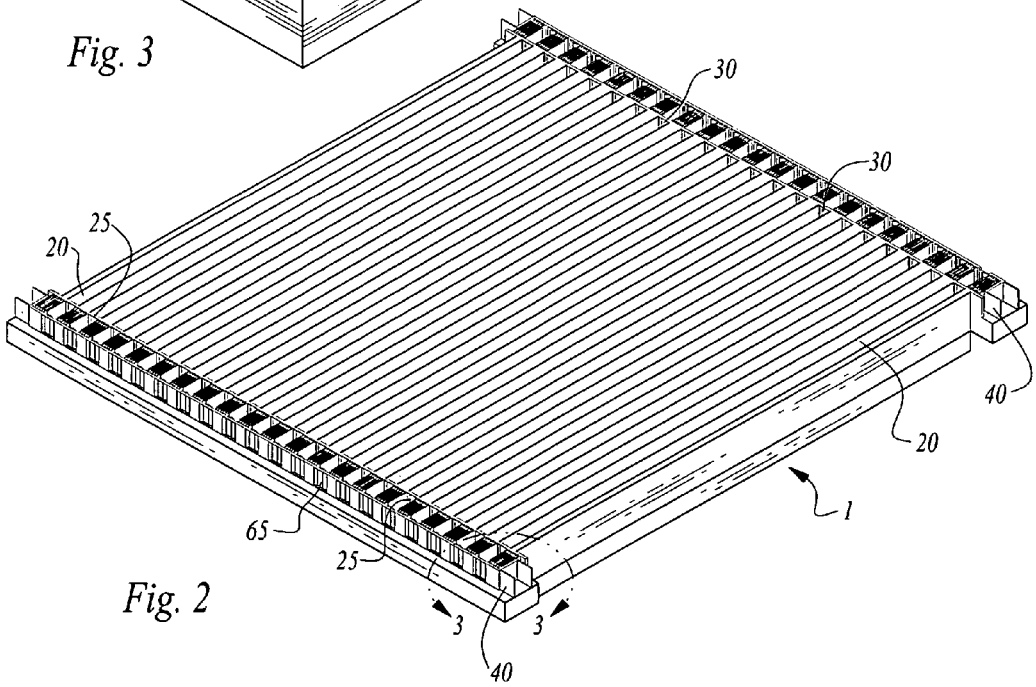
FIG. 2 shows exposed internal elements of the MEMS cooling device of the invention with the top seal removed.

Turning now to FIG. 2, interior elements of MEMS cooling device 1 are shown, reflecting MEMS cooling device 1 with the lid structure removed. One or more channel volumes 20 are provided for the circulation of a coolant, such as water, from an inlet port 25, through channel volume 20, to an outlet port 30. The reflected embodiment shows channel volume widths ranging from about 7 to about 100 microns in width and a total package thickness ranging from about 100 to 500 microns.

During operation, heat from an integrated circuit chip adjacent MEMS cooling device 1 is conducted into MEMS cooling device 1 and absorbed by the coolant within channel volume 20. The heat will be removed from the IC die by circulating the coolant to an external heat exchanger by means of the MEMS micro-pump assembly discussed further below.

Figure 3:
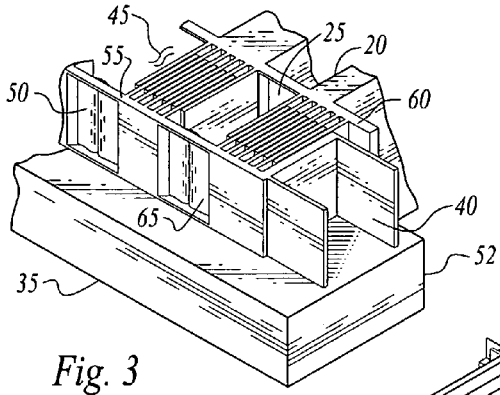
FIG. 3 shows a detail of FIG. 2 and illustrates a preferred embodiment of the micro-pump assembly of the invention wherein the valve elements are disposed within a frame.
Figure 4:
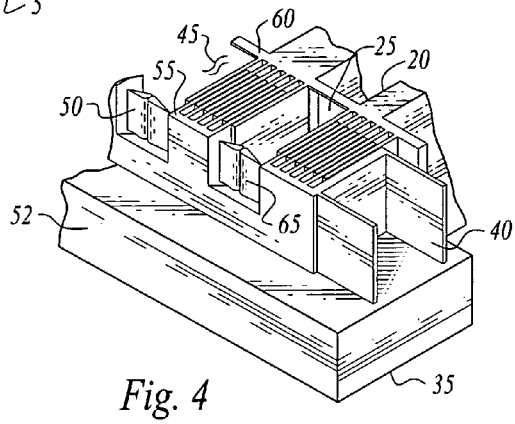
FIG. 4 shows an alternative preferred embodiment of the micro-pump assembly of the invention wherein the valve elements are disposed over a lower stiffening member.

FIGS. 3 and 4 illustrate alternative preferred embodiments of a detail of FIG. 2 and illustrate elements of the micro-pump assembly 35 of the invention. FIG. 3 shows the valve elements of the invention defined within a frame while FIG. 4 shows the valve elements of the invention defined over a lower stiffening member.

Micro-pump assembly 35 comprises one or more flexure arms 40 which are fixedly attached to a stationary portion of the MEMS cooling device structure, valve drive means 45 and, in a preferred embodiment, one or more flexible leaf valve structures 50 comprising one or more valve elements.

The illustrated preferred embodiment reflects a valve drive means 45 comprising a set of interleaved and opposing electrostatic comb drive structures flexibly suspended above a silicon substrate 52. In the illustrated embodiment, a set of movable comb drive structures 55 is in mechanical connection with flexure arms 40 whereby the set of movable comb drive structures 55 are permitted to travel substantially parallel and planar to, and oscillate within, an opposing fixed set of comb drive structures 60 depending upon the potential voltage difference applied to the respective micro-pump comb drive elements.

As is applicable to any of the electrostatic valve drive means described herein, the rate and phase of valve oscillation or vibration may be independently controlled by independently varying the frequency and duty cycle of the voltages applied to the various pump elements.

It is expressly noted that, while this illustrated embodiment shows a single set of interleaved comb drive elements for the driving of a set of movable comb drive elements 55 in a single direction (i.e., inward toward fixed set of comb drive structures 60), two opposing fixed sets of interleaved comb drive elements (discussed below) may be provided whereby the set of movable comb drive structures 55 is driven in opposing directions (inward and outward) to enhance the stroke of the valve elements mechanically connected thereto.

Examples of oscillating MEMS comb drive structures are disclosed in U.S. Pat. No. 6,715,352, "Method of Designing a Flexure System for Tuning the Modal Response of a Decoupled Micromachined Gyroscope and a Gyroscope Designed According to the Method", to Tracey; U.S. Pat. No. 6,089,089, "Multi-Element Micro Gyro", to Hsu; and U.S. Pat. No. 6,578,420, "Multi-Axis Micro-Gyro Structure", to Hsu, all assigned to Irvine Sensors Corp., assignee herein, and the entirety of each of which is fully incorporated herein.

Leaf valve structures 50 comprise one or more movable valve elements 65 in mechanical connection with flexure arms 40 and a set of movable comb drive structures 55. Valve elements 65, as illustrated, are a pair of one-way flexure leaf valves 50 configured to open inward and toward inlet port 25, dependent upon the coolant pressure differential on the respective sides of valve elements 65 and on the coolant fluid resistance encountered by the valve elements 65. The illustrated pair of valve elements 65 have a width ranging from about 3 to about 50 microns per element.

Figures 5, 6, 7:
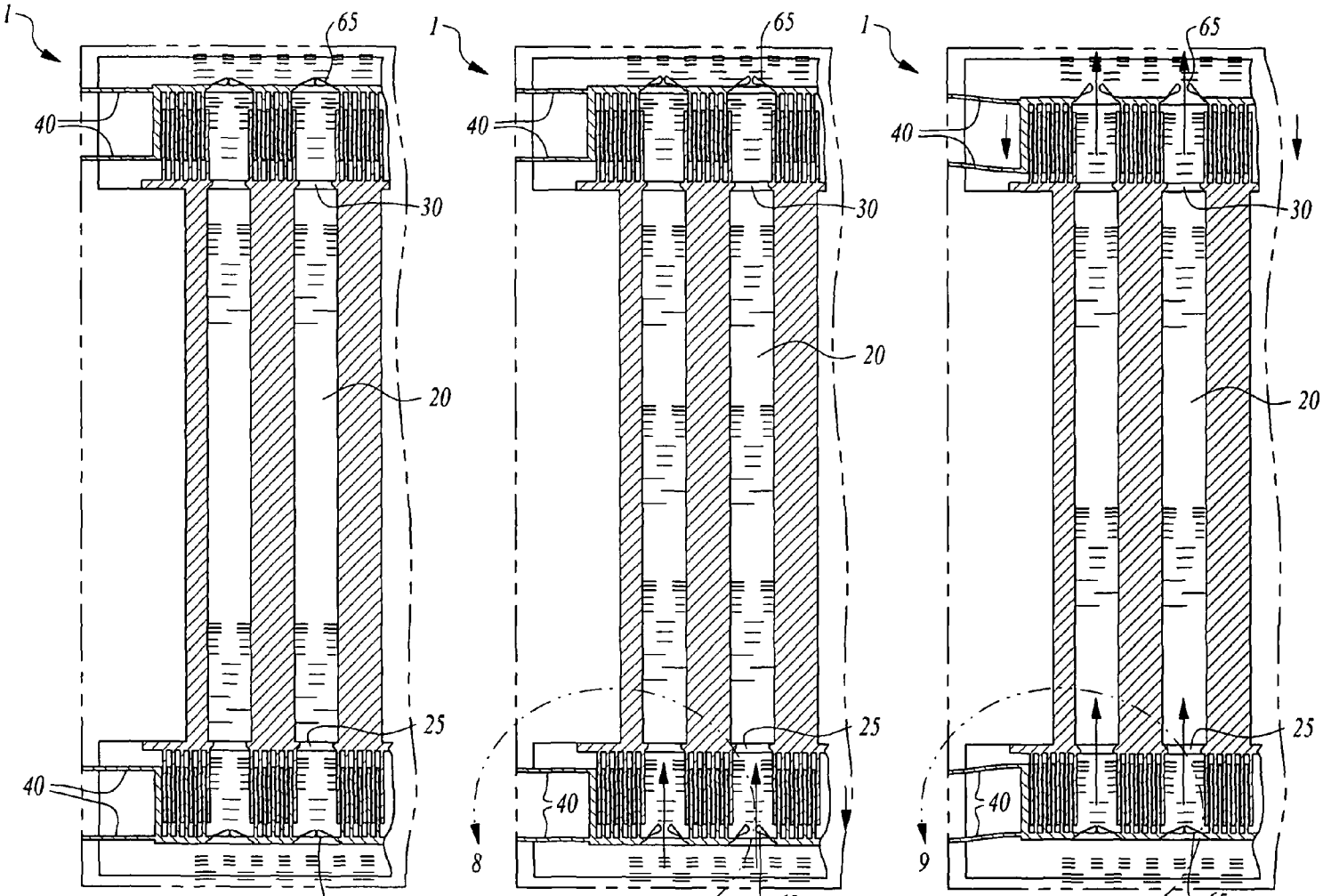
FIG. 5 shows a view of a portion of the MEMS cooling device of the invention in a neutral state.
FIG. 6 shows a view of a portion of the MEMS cooling device of the invention having an inlet micro-pump assembly and an outlet pump assembly during a coolant inlet cycle.
FIG. 7 shows a view of a portion of the MEMS cooling device of the invention having an inlet micro-pump assembly and an outlet pump assembly during a coolant outlet cycle.

Turning now to FIG. 5, an alternative embodiment showing dual, complementary micro-pump assemblies 35 proximal to inlet port 25 and outlet port 30 respectively, are shown. The use of dual micro-pump assemblies provides additional coolant pumping capacity for the device in high heat removal applications. Controlling the frequency and phase between the two micro-pump assembles also provides additional means for controlling the flow rate and pressure levels of the coolant in the cooling system.

FIG. 5 illustrates MEMS cooling device 1 in a non-operating, static position, wherein there is no voltage differential applied to any of the comb drive structures. As illustrated, flexure arms 40 are unbiased and at rest, valve elements 65 are closed and there is no coolant flow through channel volumes 20.

Figure 8:
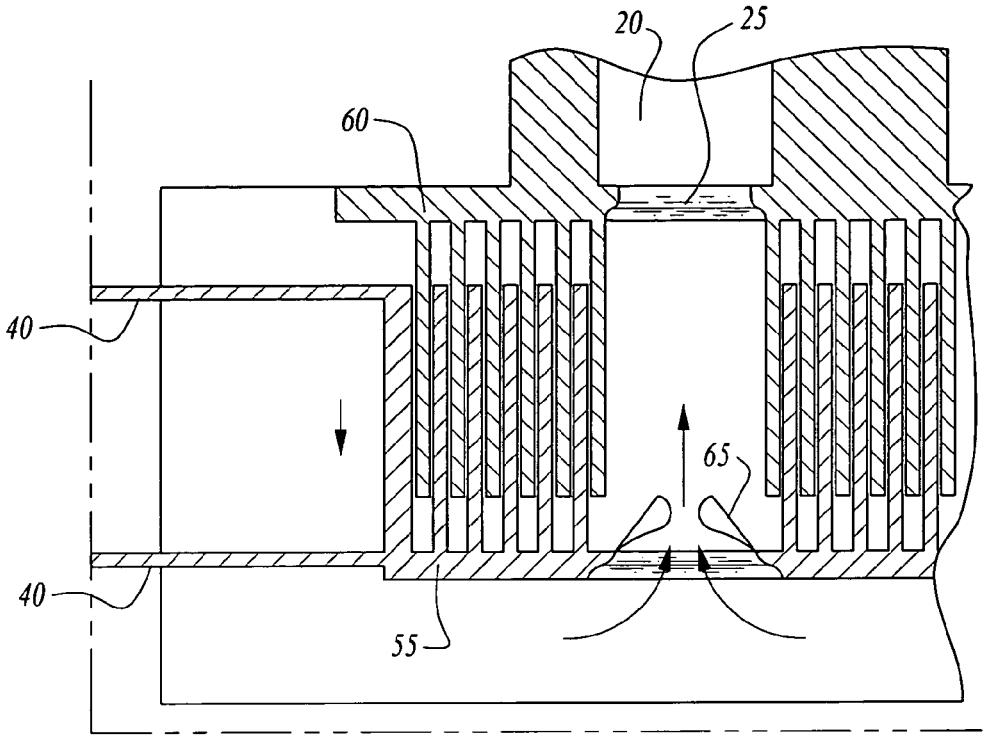
FIG. 8 shows a detail view of FIG. 6.
Figure 9:
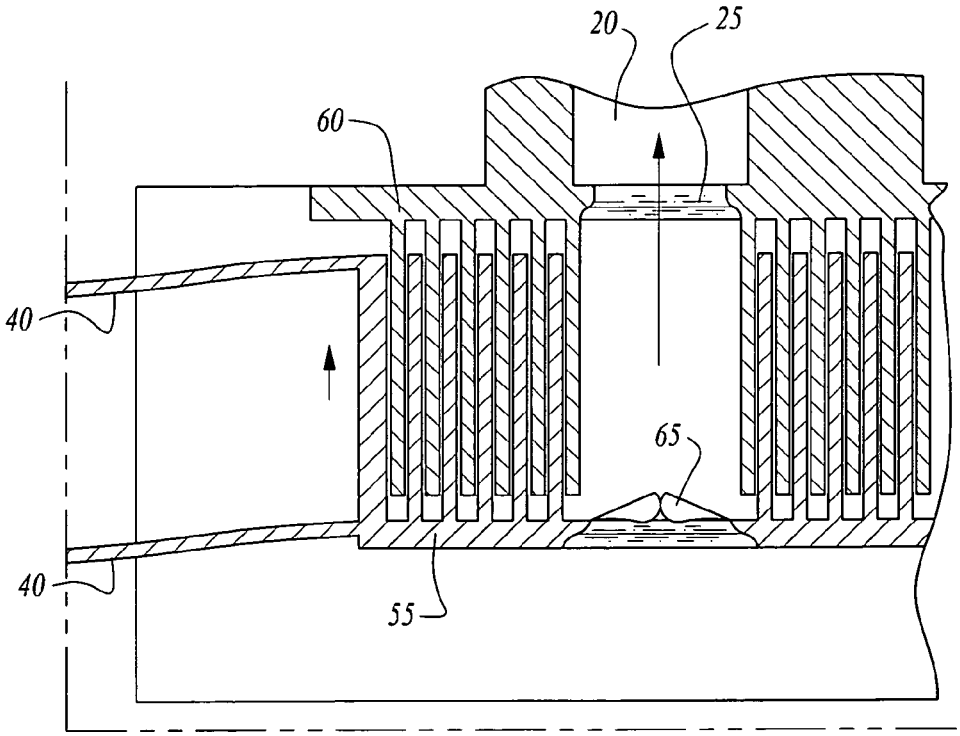
FIG. 9 shows a detail view of FIG. 7.
Figure 10:
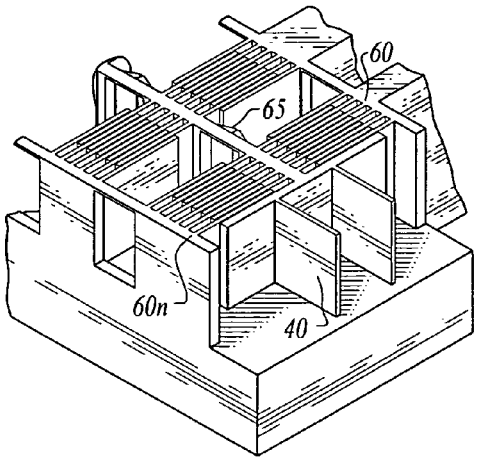
FIG. 10 shows the micro-pump assembly of the invention with dual opposing stationary comb drive structures.

FIGS. 6 and 7 and corresponding detail FIGS. 8 and 9 show the positioning of elements of the MEMS cooling device 1 at two phases in an operational pump cycle.

FIGS. 6 and 8 illustrate a coolant inlet stroke of the pump cycle wherein the channel volumes 20 of the assembly are filled with a coolant and the micro-pump assembly 35 proximal inlet port 25 has been drawn from an inwardly biased position to its neutral position, i.e., flexure arms 40 are in a neutral position and are not flexed.

The outward travel or "sweep" of valve elements 65 of the micro-pump assembly 35 and the set of moveable comb drive structures 55 in this cycle urge valve elements 65 against the fluid resistance of the coolant in which valve elements 65 are disposed. This, in turn, causes valve elements 65 to swing open inwardly toward channel volume 20. As the set of movable comb drive structures 55 continue the outward stroke, lower temperature coolant from inlet conduit 10 is introduced through valve elements 65 and into the respective channel volumes 20.

Now, relative to FIGS. 7 and 9, the coolant outlet stroke of the pump cycle is illustrated. A varying predetermined potential voltage difference is introduced with respect to the stationary comb drive structures 60 and the set of moveable comb drive structures 55. The potential voltage difference between the above elements electro-statically urges the set of moveable comb drive structures 55 inwardly toward or outwardly from the set of stationary comb drive structures 60.

As the outlet stroke begins, the angular disposition of valve elements 65 as they are drawn inwardly with respect to the coolant urges valve elements 65 closed, temporarily sealing the illustrated valve aperture during this cycle of operation. As the set of stationary comb drive structures 60 is further urged inwardly, the coolant on the channel volume side of valve elements 65 is pressurized and pumped through channel volume 20, toward and through outlet port 30, where it is circulated to an external heat exchanger via outlet conduit 10 for heat removal to anther location.

In a preferred embodiment of the invention, micro-pump assembly 35 is operated a frequency of about 10 kHz.

In an alternative embodiment shown in FIGS. 10, 11, 12 and 13, a pair of opposing stationary comb drive structures 60 and 60*a* are provided. The opposing sets of stationary comb drive structures 60 and 60*a* are electrically isolated whereby each set of stationary comb drive structures can be provided with an independent predetermined comb drive voltage such that the interposed valve elements 65 can be electro-statically urged in an inward and an outward direction, resulting in a longer valve stroke length.

Figure 11:
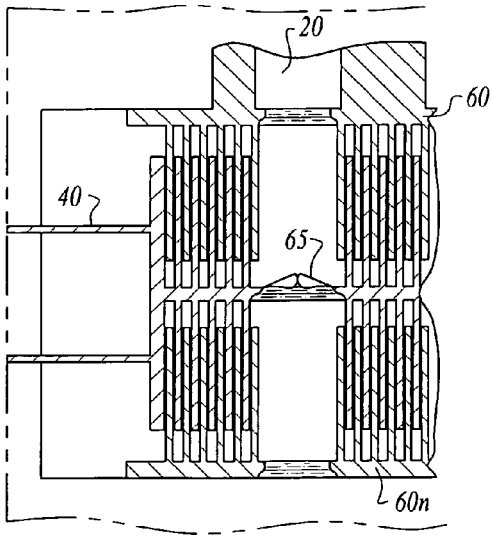
FIG. 11 shows the micro-pump assembly of the invention with dual opposing stationary comb drive structures in a neutral state.

FIG. 11 shows the dual stationary comb drive embodiment in a static, non-operating state wherein valve elements 65 are closed and flexure arms 40 are in a neutral position.

Figure 12:
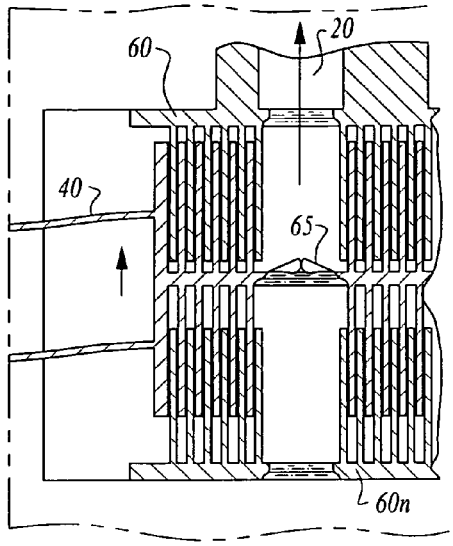
FIG. 12 shows the micro-pump assembly of the invention with dual opposing stationary comb drive structures during a coolant outlet cycle.

FIG. 12 illustrates the outlet cycle of the device wherein moveable comb structure 55 is urged inwardly toward channel volume 20 by means of a potential voltage difference between the stationary and movable comb drive structures with the coolant fluid resistance having closed valve elements 65. The resulting inward throw of valve elements 65 urges the heated coolant toward and out of outlet port 30 such that it can be circulated out through outlet conduit 15 to an external heat exchanger.

Figure 13:
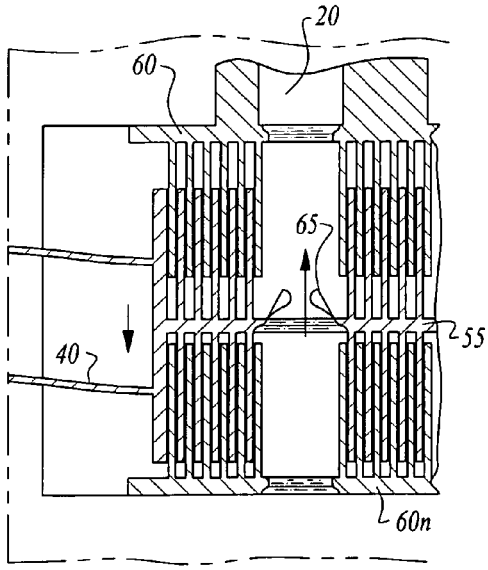
FIG. 13 shows the micro-pump assembly of the invention with dual opposing stationary comb drive structures during a coolant inlet cycle.

FIG. 13 illustrates the inlet cycle of the device wherein the set of movable comb drive structures 55 is urged toward the opposing stationary comb drive structure 60*a* by means of a predetermined potential voltage difference applied between the elements. The outward stroke of valve elements 65 against the fluid resistance of the coolant in which they are disposed opens valve elements 65 inwardly, allowing lower temperature coolant to enter channel volume 20 from inlet conduit 10.

It must be understood that the illustrated embodiment has been set forth only for the purpose of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed even when not initially claimed in such combinations.

Alternative valve drive means 45 for driving valve elements 65 may be utilized in the invention, including, for example and not by way of limitation, piezo-electric, piezo-crystal, parallel plate electrostatic or magnetic drive means.

Figure 14:
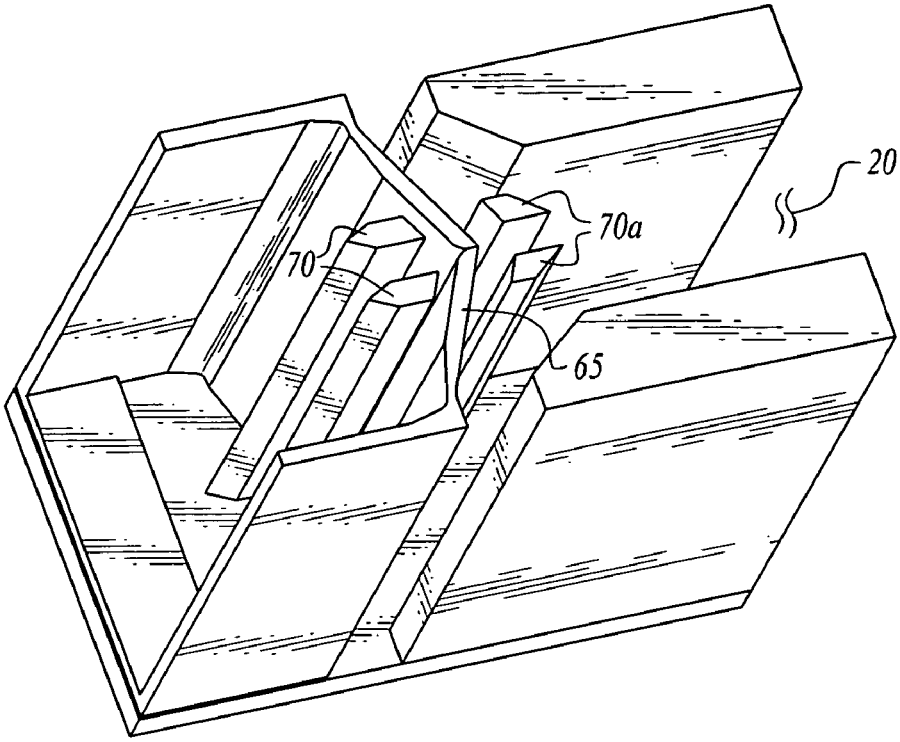
FIG. 14 shows a view of the valve elements of the invention in cooperation with two pairs of electrode columns.

For instance, one or more electrode columns 70 and 70*a* may be provided to drive or assist in driving valve elements 65 as disclosed in FIG. 14. Electrode columns 70 and 70*a* may have a predetermined voltage applied such that the potential voltage difference between valve elements 65 and respective electrode columns 70 and 70*a* (or pairs of columns) will electro-statically urge or repel the respective elements toward or away from each other.

In this manner, the individual valve elements 65 may be electro-statically opened and closed, depending on the relative applied voltages and the frequency and duty cycle of such applied voltages. In one embodiment, the electrode columns 70 and/or 70*a* alone can be used to open and close valve elements 65 or, in an alternative embodiment, electrode columns 70 and/or 70*a* can be used cooperatively with a vibrating or oscillating valve drive means for the micro pump assembly.

The words used in this specification to describe the invention and its various embodiments are to be understood not only in the sense of their commonly defined meanings, but to include by special definition in this specification, structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims are therefore defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Although elements may be described above as acting in certain combinations and even initially claimed as such, it is to be expressly understood that one or more elements from a claimed combination can, in some cases be excised from the combination and that the claimed combination may be directed to a sub-combination or variation of a sub combination.

Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the fundamental idea of the invention.

I claim:

1. A micro-electromechanical (MEMS) cooling device comprising:

a first channel volume configured to transfer heat from a separate first device to a coolant;

a first inlet port and a first outlet port in fluid communication with the first channel volume;

a first MEMS micro-pump assembly comprising:

a first valve drive configured to move the coolant through the first channel volume, and a first valve assembly in fluid communication with the first channel volume and driven by the first valve drive;

a second channel volume configured to transfer heat from the separate first device or to the coolant;

a second inlet port and a second outlet port in fluid communication with the second channel volume; and a second MEMS micro-pump assembly comprising:

a second valve drive configured to move the coolant through the second channel volume, and a second valve assembly in fluid communication with the second channel volume and driven by the second valve drive.

2. The MEMS cooling device of claim 1, wherein the MEMS cooling device is formed of a material that comprises silicon.

3. The MEMS cooling device of claim 1, wherein at least one of the first or second valve drives includes interleaved electrostatic comb drive structures.

4. The MEMS cooling device of claim 1, wherein at least one of the first or second valve drives includes parallel plate electrostatic elements.

5. The MEMS cooling device of claim 1, wherein at least one of the first or second valve drives includes a piezo-crystal element.

6. The MEMS cooling device of claim 1, wherein at least one of the first or second valve assemblies includes a leaf valve.

7. The MEMS cooling device of claim 6, wherein the leaf valve comprises a movable valve element that is mechanically connected to a flexure arm that is fixedly attached to a stationary portion of the MEMS cooling device.

8. The MEMS cooling device of claim 1, wherein the first MEMS micro-pump assembly includes a flexure arm fixedly attached to a stationary portion of the MEMS cooling device.

9. The MEMS cooling device of claim 1, wherein the first valve assembly is configured to open or close based at least in part on a pressure differential between a first side of the first valve assembly and a second side of the first valve assembly.

10. The MEMS cooling device of claim 1, wherein the first valve drive further comprises first and second electrode columns, wherein the first and second electrode columns each have an applied predetermined voltage that can be controlled independently of other of the electrode columns.

11. The MEMS cooling device of claim 10, wherein the first valve assembly is configured to open or close based at least in part on the applied predetermined voltage for each of the first and second electrode columns.

12. The MEMS cooling device of claim 1, further comprising an inlet conduit configured to transfer fluid to the first and second inlet ports and an outlet conduit configured to transfer fluid away from the first and second outlet ports.

13. The MEMS cooling device of claim 1, wherein the first channel volume includes a first end and a second end opposite the first end, wherein the first inlet port is located adjacent to the first end of the first channel volume, and wherein the first outlet port is located adjacent to the second end of the first channel volume.

14. The MEMS cooling device of claim 1, wherein the first valve drive is disposed proximate the first inlet port or the first outlet port such that no coolant lines or piping is disposed between the first valve drive and the first inlet or first outlet port.

15. The MEMS cooling device of claim 1, wherein the second channel volume is adjacent to the first channel volume, wherein the first valve drive is disposed proximate the first inlet port or the first outlet port, and wherein the second valve drive is disposed proximate the second inlet port or the second outlet port.

16. A micro-electromechanical (MEMS) cooling device comprising:

a first channel volume and a second channel volume configured to transfer heat from a first device to a coolant;

a first inlet port and a first outlet port in fluid communication with the first channel volume;

a second inlet port and a second outlet port in fluid communication with the second channel volume;

a first micro-pump assembly configured for pumping the coolant into the first channel volume and a second micro-pump assembly configured for pumping the coolant into the second channel volume; and a third micro-pump assembly configured for pumping the coolant out of the first channel volume and a fourth micro-pump assembly configured for pumping the coolant out of the second channel volume, wherein at least one of the first, second, third, or fourth micro-pump assemblies comprise:

a valve drive disposed proximate the corresponding inlet port or the corresponding outlet port; and a valve assembly in fluid communication with the corresponding channel volume and wherein the valve assembly is driven by its corresponding valve drive.

17. The MEMS cooling device of claim 16, wherein the first micro-pump assembly and the second micro-pump assembly are configured to be separately controlled by separate predetermined voltages.

18. The MEMS cooling device of claim 16, wherein at least one of the valve drives comprises dual opposing stationary comb drive structures.

19. The MEMS cooling device of claim 16, wherein at least a portion of the cooling device is formed from a material that includes silicon.

20. The MEMS cooling device of claim 16, wherein at least one of the valve drives comprises interleaved electrostatic comb drive structures.

21. The MEMS cooling device of claim 16, wherein at least one of the valve drives comprises a set of parallel plate electrostatic elements.

22. The MEMS cooling device of claim 16, wherein at least one of the valve drives comprises a piezo-crystal element.

23. The MEMS cooling device of claim 16, wherein at least one of the valve assemblies comprises a leaf valve.

24. The MEMS cooling device of claim 16, wherein at least one of the valve drives further comprises first and second electrode columns, wherein the first and second electrode columns each have an applied predetermined voltage that can be controlled independently of the other electrode column.

25. The MEMS cooling device of claim 24, wherein at least one of the valve assemblies is configured to open or close based at least in part on the applied predetermined voltage for each of the first and second electrode columns.

26. The MEMS cooling device of claim 16, wherein at least one of the first micro-pump assembly or the second micro-pump assembly includes a flexure arm fixedly attached to a stationary portion of the MEMS cooling device.

27. The MEMS cooling device of claim 16, wherein at least one of the valve assemblies is configured to open or close based at least in part on a pressure differential between a first side and a second side of the at least one of the valve assemblies.

28. The MEMS cooling device of claim 16, wherein the first channel volume includes a first end and a second end opposite the first end, wherein the first inlet port is located adjacent to the first end of the first channel volume, and wherein the first outlet port is located adjacent to the second end of the first channel volume.

29. A method for cooling a micro-electromechanical system (MEMS) device comprising:

activating a first valve drive to open a first valve assembly of a first micro-pump assembly, wherein the first valve drive is in fluid communication with a first channel volume;

activating a second valve drive to open a second valve assembly of a second micro-pump assembly, wherein the second valve drive is in fluid communication with a second channel volume;

pumping a coolant through the first and second valve assemblies into the first and second channel volumes;

activating a third valve drive to open a third valve assembly of a third micro-pump assembly, wherein the third valve drive is in fluid communication with the first channel volume;

activating a fourth valve drive to open a fourth valve assembly of a fourth micro-pump assembly, wherein the fourth valve drive is in fluid communication with the second channel volume; and pumping the coolant through the third and fourth valve assemblies out of the first and second channel volumes.

30. The method of claim 29, wherein at least one of the first valve drive and the second valve drive includes dual opposing stationary comb drive structures.

31. The method of claim 29, wherein at least one of the first valve drive and the second valve drive includes an interleaved electrostatic comb drive structure.

32. The method of claim 29, wherein at least one of the first valve assembly or the second valve assembly is configured to open or close based at least in part on a pressure differential between a first side and a second side of the at least one of the first valve assembly and the second valve assembly.

33. The method of claim 29, wherein at least one of the first valve drive and the second valve drive includes a set of parallel plate electrostatic elements or a piezo-crystal element.

* * * * *